US009988992B2

(12) United States Patent
Lauritano et al.

(10) Patent No.: US 9,988,992 B2
(45) Date of Patent: Jun. 5, 2018

(54) METHOD OF OPERATING A FUEL SYSTEM OF AN INTERNAL COMBUSTION ENGINE

(71) Applicant: GM GLOBAL TECHNOLOGY OPERATIONS LLC, Detroit, MI (US)

(72) Inventors: Luca Lauritano, Turin (IT); Pietro Orlando, Turin (IT)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 161 days.

(21) Appl. No.: 15/014,566

(22) Filed: Feb. 3, 2016

(65) Prior Publication Data

US 2017/0218858 A1 Aug. 3, 2017

(51) Int. Cl.
*F02D 29/06* (2006.01)
*F02D 41/30* (2006.01)
*F02D 41/26* (2006.01)

(52) U.S. Cl.
CPC ..... *F02D 29/06* (2013.01); *F02D 41/26* (2013.01); *F02D 41/30* (2013.01); *F02D 2200/503* (2013.01)

(58) Field of Classification Search
CPC ..... F02D 29/06; F02D 41/04; F02D 41/30–41/408; F02D 2200/503; F02D 2250/24
USPC ..... 701/103–104; 123/339.18; 290/40 R–40 C
See application file for complete search history.

(56) References Cited

U.S. PATENT DOCUMENTS 4,833,887 A * 5/1989 Kawamura ..... F02B 37/10 290/40 C
4,862,369 A * 8/1989 Yakuwa ..... F02D 41/105 123/487
5,712,786 A * 1/1998 Ueda ..... F02D 31/005 123/339.1
6,434,469 B1 * 8/2002 Shimizu ..... B60K 6/44 180/197
7,812,469 B2 * 10/2010 Asada ..... F02D 41/083 290/40 A
8,342,142 B2 * 1/2013 Shintani ..... F01P 7/164 123/41.12
9,184,686 B2 * 11/2015 Minamiguchi ..... B60W 30/20
9,356,548 B2 * 5/2016 Ookawa ..... B60W 30/02
2005/0263333 A1 * 12/2005 Fujiki ..... B60K 6/48 180/65.25

* cited by examiner

*Primary Examiner* — Erick Solis
*Assistant Examiner* — Robert Werner
(74) *Attorney, Agent, or Firm* — Lorenz & Kopf, LLP

(57) ABSTRACT

A method of operating an internal combustion engine, and more particularly a fuel injector is disclosed. The fuel injector is commanded to inject a fuel requested quantity. The fuel requested quantity is adjusted by closed-loop for controlling an engine speed to match a target value thereof. A value of a first parameter indicative of an amount of electrical energy supplied to an electric battery by an electric generator coupled to the internal combustion engine is measured. A value of a voltage generated by the electric battery and a value of the engine speed are measured. A reference value of the fuel requested quantity is calculated on the basis of the voltage value, the engine speed value and the value of the first parameter. A difference between the value of the adjusted fuel requested quantity and the reference value is calculated and used to control the internal combustion engine.

7 Claims, 3 Drawing Sheets

METHOD OF OPERATING A FUEL SYSTEM OF AN INTERNAL COMBUSTION ENGINE

TECHNICAL FIELD

The present disclosure pertains to a method of operating an internal combustion engine, especially an internal combustion engine of a motor vehicle.

BACKGROUND

It is known that an internal combustion engine, for example a Diesel engine, includes at least one fuel injector provided for injecting metered quantity of fuel into a corresponding engine cylinder. The fuel injector is controlled by an electronic control module (ECM) which is generally configured to determine a fuel requested quantity that should be injected into the engine cylinder and to command the fuel injector to inject said fuel requested quantity. However, production spread and tolerances have the effect that the quantity of fuel actually injected by the fuel injector is generally different from the fuel requested quantity and this difference may have a relevant impact especially when a small fuel quantity is concerned (e.g. a pilot injection), thereby increasing pollutant emissions, combustion noises and vibrations.

In order to guarantee that the fuel injector is able to actually inject small fuel quantities that correspond to the requested fuel quantities with sufficient accuracy, a learning procedure is usually carried out at the end of the production line of the internal combustion engine and/or after any replacement of the fuel injector. This learning procedure generally provides for the ECM to adjust the fuel requested quantity by controlling the engine speed (i.e. the rotational speed of the internal combustion engine) in a closed-loop control, so that the engine speed matches a target value thereof (e.g. the idle speed).

While the internal combustion engine is operating in this way, the ECM calculates a reference value of the fuel requested quantity that corresponds to the fuel quantity that would be requested from a nominal fuel injector in order to bring and keep the engine speed at the target value. This reference value is subtracted from the value of the fuel request quantity under which the fuel injector is actually commanded by the closed-loop control and such difference is memorized to correct the values of the fuel requested quantity during the normal operation of the internal combustion engine.

The calculation of the aforementioned reference value of the fuel requested quantity is conventionally carried out on the basis of a PWM signal, usually referred as to F-terminal signal, which is generated by an electric generator (e.g. an alternator) coupled to the internal combustion engine and whose duty-cycle represents an amount of mechanical energy that the internal combustion engine is supplying to said electric generator in order to charge an electric battery. However, the F-terminal signal does not comply with the severe diagnostic protocols required by the OBD-II standards, so that the entire learning strategy is not OBD-II compliant.

SUMMARY

The present disclosure is that of providing a solution for making the learning strategy OBD-II compliant, without modifying the hardware and the software involved in the current diagnostic protocols of the F-terminal signal and thus without implying a relevant increase of the costs. An embodiment of the solution provides the following method of operating an internal combustion engine. A fuel injector of the internal combustion engine is commanded to inject a fuel requested quantity. The fuel requested quantity is adjusted by closed-loop controlling an engine speed to match a target value thereof. A value of a first parameter indicative of an amount of electrical energy supplied to an electric battery is measured by an electric generator coupled to the internal combustion engine. A value of a voltage generated by the electric battery is measured. A value of the engine speed is measured. A reference value of the fuel requested quantity is calculated on the basis of the voltage value, the engine speed value and the value of the first parameter. A difference between a value of the adjusted fuel requested quantity and the reference value is calculated. The calculated difference is used to control the operation of the internal combustion engine.

In particular, the aforementioned first parameter may be a duty-cycle of a PWM signal, usually referred as to L-terminal signal, which is generated by the ECM to control the operation of the electric generator and which represents an amount of energy that the electric generator has to supply to the electric battery in order to charge it. Since the measurements of the voltage value, of the engine speed value and of the value of the first parameter are OBD-II compliant, the effect of this solution is that the calculation of the reference value of the fuel requested quantity becomes OBD-II compliant, without changing the hardware and/or the software involved in the diagnostic protocols of the F-terminal signal. As a direct consequence, the entire learning procedure (i.e. the calculation of the difference between the actual value of the fuel requested quantity and the reference value thereof) becomes reliable and robust enough to guarantee that the pollutant emissions of the internal combustion engine, the combustion noises and vibrations can be efficiently reduced.

According to an aspect of this solution, the method may include setting a target value of a second parameter indicative of an amount of mechanical energy supplied by the internal combustion engine to the electric generator. The first parameter is set by closed-loop controlling the second parameter to match the target value thereof. The target value of the second parameter is used for the calculation of the reference value of the fuel requested quantity. In particular, the aforementioned second parameter may be the duty-cycle of the F-terminal PWM signal. The effect of this aspect is that of improving the accuracy of the reference value of the fuel requested quantity which is involved in the learning procedure.

According to another aspect of the method, the calculation of the reference value of the fuel requested quantity may include estimating a value of the second parameter on the basis of the voltage value, the engine speed value, the value of the first parameter and the target value of the second parameter. The reference value of the fuel requested quantity is determined on the basis of the estimated value of the second parameter. Thanks to this aspect, the determination of the reference value of the fuel requested quantity may be performed according to the conventional strategies based on the F-terminal signal, so that the proposed method may be implemented without significantly changing the global logic of the learning procedure.

According to another aspect of the method, the estimation of the value of the second parameter may include a calculation of the value $FDC_{est}$ of the second parameter with the following equation:

$$FDC_{est}=(LDC\cdot k_1+V\cdot k_2)\cdot k_3$$

wherein:

LDC is the value of the first parameter;

V is the voltage value;

$k_1$ and $k_2$ are numeric coefficients determined on the basis of the target value of the second parameter; and $k_3$ is a numeric coefficient determined on the basis of the target value of the second parameter and the engine speed value.

This aspect provides a reliable solution for calculating the value of the second parameter without a too much computational effort.

According to an aspect of the solution, the method may include generating a failure signal, if a difference between the estimated value of the second parameter and the target value thereof is larger than a predetermined threshold value. This aspect has the effect of signaling that something went wrong with the estimation, so that this information may be used to abort the learning procedure or to prevent that clearly unreliable results of the learning procedure can be subsequently used to control the operation of the internal combustion engine.

According to another aspect of the method, the setting of the target value of the second parameter may include measuring a value of the voltage generated by the electric battery, measuring a value of the first parameter, and determining the target value of the second parameter on the basis of the voltage value and of the value of the first parameter. This aspect has the effect of setting a target value of the second parameter which is expected to be compatible with the current state of charge of the electric battery, and so which can be followed by adjusting the first parameter in the closed-control loop.

According to another aspect of the method, the setting of the target value of the second parameter may include calculating a variation rate of the first parameter over time, decreasing the target value of the second parameter, if the variation rate of the first parameter is greater than a predetermined positive threshold value thereof, and increasing the target value of the second parameter, if the variation rate of the first parameter is smaller than a predetermined negative threshold value thereof. This aspect has the effect of allowing a regulation of the target value of the second parameter when the target value initially set is not actually compatible with the current state of charge of the battery, so that it cannot be followed by adjusting the first parameter in the closed-loop control.

The present solution may be also embodied in the form of a computer program including a computer-code for performing the method described above when run on a computer, or in the form of a computer program product including a non-transitory machine readable carrier on which said computer program is stored. In particular, the present disclosure may be embodied in the form of a control apparatus for an internal combustion engine including an electronic control module, a data carrier associated to the electronic control module and the computer program stored in the data carrier.

Another embodiment of the present disclosure provides an apparatus for operating an internal combustion engine having an electronic control module configured to command a fuel injector of the internal combustion engine to inject a fuel requested quantity, adjust the fuel requested quantity by closed-loop controlling an engine speed to match a target value thereof, and measure a value of a first parameter indicative of an amount of electrical energy supplied to an electric battery by an electric generator coupled to the internal combustion engine. The electronic control module is operable with various vehicle sensors to measure a value of a voltage generated by the electric battery and a value of the engine speed. The engine control module is also configured to calculate a reference value of the fuel requested quantity on the basis of the voltage value, the engine speed value and the value of the first parameter, calculate a difference between a value of the adjusted fuel requested quantity and the reference value, and use the calculated difference to control the operation of the internal combustion engine. This embodiment achieves basically the same effects of the method above, in particular that of making the learning procedure OBD-II compliant, without changing the hardware and/or the software involved in the diagnostic protocols of the F-terminal signal.

According to an aspect of this solution, the electronic control module may be configured to set a target value of a second parameter indicative of an amount of mechanical energy supplied by the internal combustion engine to the electric generator, adjust the first parameter by closed-loop controlling the second parameter to match the target value thereof, and use the target value of the second parameter for the calculation of the reference value of the fuel requested quantity. The effect of this aspect is that of improving the accuracy of the reference value of the fuel requested quantity which is involved in the learning procedure.

According to another aspect of the apparatus, the electronic control module is configured to estimate a value of the second parameter on the basis of the voltage value, the engine speed value, the value of the first parameter and the target value of the second parameter and determine the reference value of the fuel requested quantity on the basis of the estimated value of the second parameter when calculating the reference value of the fuel requested quantity. Thanks to this aspect, the determination of the reference value of the fuel requested quantity may be performed according to the conventional strategies based on the F-terminal signal.

According to another aspect of the apparatus, the value of the second parameter may be estimated with the electronic control module by calculating the value $FDC_{est}$ of the second parameter with the following equation:

$$FDC_{est}=(LDC\cdot k_1+V\cdot k_2)\cdot k_3$$

wherein:

LDC is the value of the first parameter;

V is the voltage value;

$k_1$ and $k_2$ are numeric coefficients determined on the basis of the target value of the second parameter; and $k_3$ is a numeric coefficient determined on the basis of the target value of the second parameter and the engine speed value.

This aspect provides a reliable solution for calculating the value of the second parameter without a too much computational effort.

According to an aspect of the solution, the electronic control module may be configured to generate a failure signal, if a difference between the estimated value of the second parameter and the target value thereof is larger than a predetermined threshold value. This aspect has the effect of signaling that something went wrong with the estimation, so that this information may be used to abort the learning procedure or to prevent that clearly unreliable results of the learning procedure can be subsequently used to control the operation of the internal combustion engine.

According to another aspect of the apparatus, the electronic control module may be configured to set the target value of the second parameter by obtaining a measurement value of the voltage generated by the electric battery and a measurement value of the first parameter, and determining the target value of the second parameter on the basis of the voltage value and of the value of the first parameter. This aspect has the effect of setting a target value of the second parameter which is expected to be compatible with the current state of charge of the electric battery, and so which can be followed by adjusting the first parameter in the closed-control loop.

According to another aspect of the apparatus, the target value of the second parameter may be set by calculating a variation rate of the first parameter over time, decreasing the target value of the second parameter, if the variation rate of the first parameter is greater than a predetermined positive threshold value thereof, or increasing the target value of the second parameter, if the variation rate of the first parameter is smaller than a predetermined negative threshold value thereof. This aspect has the effect of allowing a regulation of the target value of the second parameter when the target value initially set is not actually compatible with the current state of charge of the battery, so that it cannot be followed by adjusting the first parameter in the closed-loop control.

BRIEF DESCRIPTION OF THE DRAWINGS

The present disclosure will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

Figure 1:
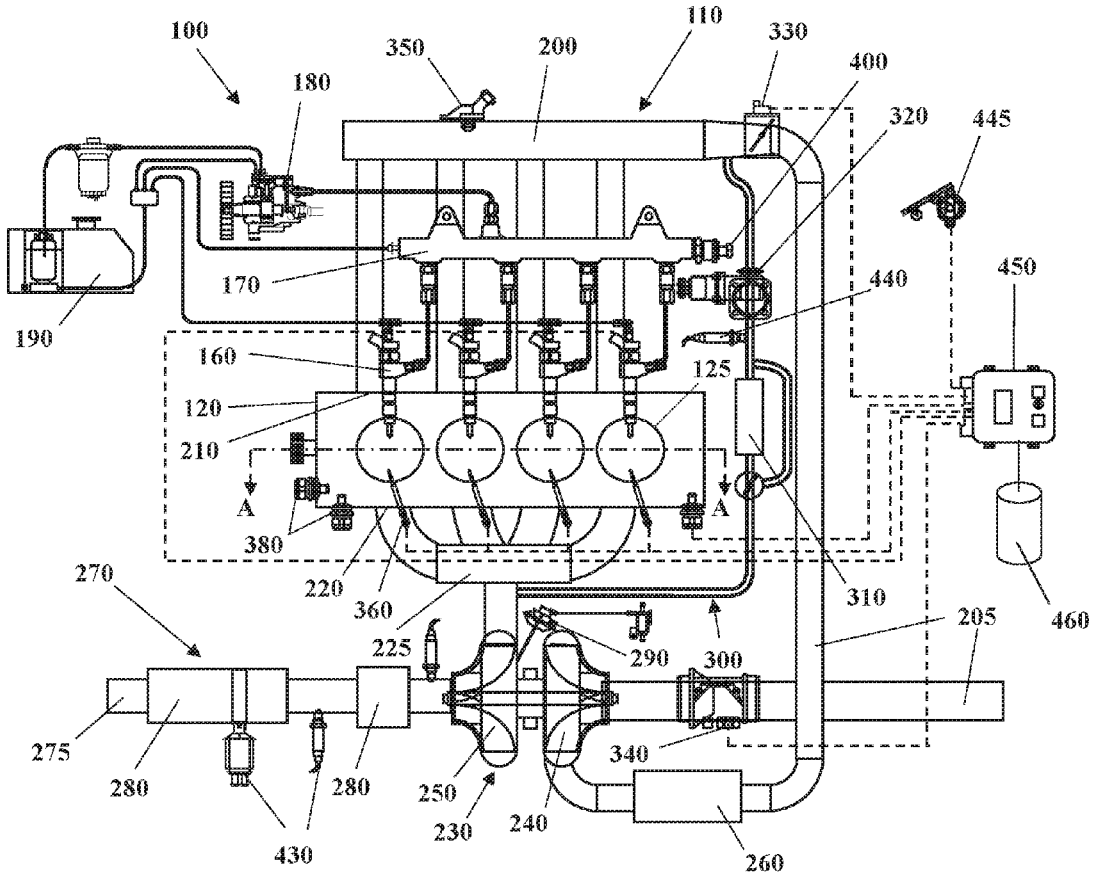
FIG. 1 shows an automotive system according to an embodiment of the disclosure.
Figure 2:
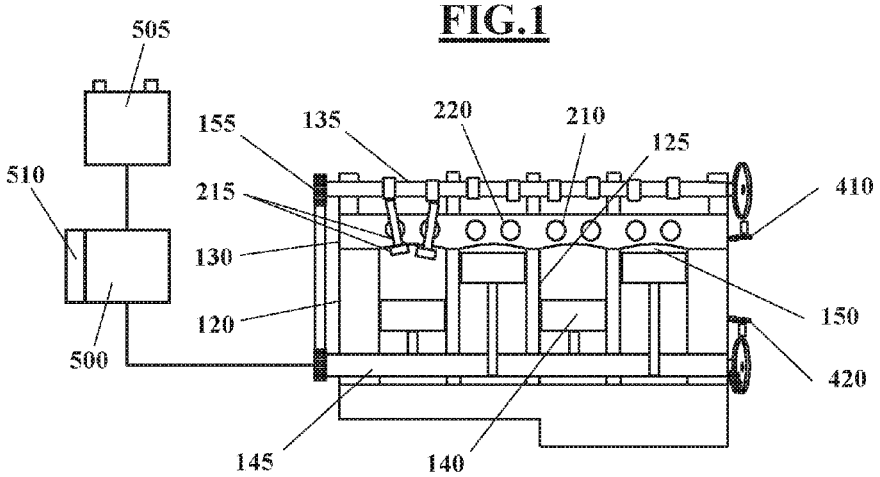
FIG. 2 is a cross-section of an internal combustion engine belonging to the automotive system of FIG. 1.

Some embodiments may include an automotive system 100 (e.g. a motor vehicle), as shown in FIGS. 1 and 2, that includes an internal combustion engine (ICE) 110 having an engine block 120 defining at least one cylinder 125 having a piston 140 coupled to rotate a crankshaft 145. A cylinder head 130 cooperates with the piston 140 to define a combustion chamber 150. A fuel and air mixture (not shown) is disposed in the combustion chamber 150 and ignited, resulting in hot expanding exhaust gases causing reciprocal movement of the piston 140. The fuel is provided by at least one fuel injector 160 and the air through at least one intake port 210. The fuel is provided at high pressure to the fuel injector 160 from a fuel rail 170 in fluid communication with a high pressure fuel pump 180 that increases the pressure of the fuel received from a fuel source 190. Each of the cylinders 125 has at least two valves 215, actuated by a camshaft 135 rotating in time with the crankshaft 145. The valves 215 selectively allow air into the combustion chamber 150 from the port 210 and alternately allow exhaust gases to exit through a port 220. In some examples, a cam phaser 155 may selectively vary the timing between the camshaft 135 and the crankshaft 145.

The air may be distributed to the air intake port(s) 210 through an intake manifold 200. An air intake duct 205 may provide air from the ambient environment to the intake manifold 200. In other embodiments, a throttle body 330 may be provided to regulate the flow of air into the manifold 200. In still other embodiments, a forced air system such as a turbocharger 230, having a compressor 240 rotationally coupled to a turbine 250, may be provided. Rotation of the compressor 240 increases the pressure and temperature of the air in the duct 205 and manifold 200. An intercooler 260 disposed in the duct 205 may reduce the temperature of the air. The turbine 250 rotates by receiving exhaust gases from an exhaust manifold 225 that directs exhaust gases from the exhaust ports 220 and through a series of vanes prior to expansion through the turbine 250. This example shows a variable geometry turbine (VGT) with a VGT actuator 290 arranged to move the vanes to alter the flow of the exhaust gases through the turbine 250. In other embodiments, the turbocharger 230 may be fixed geometry and/or include a waste gate.

The exhaust gases exit the turbine 250 and are directed into an exhaust system 270. The exhaust system 270 may include an exhaust pipe 275 having one or more exhaust after treatment devices 280. The aftertreatment devices 280 may be any device configured to change the composition of the exhaust gases. Some examples of after treatment devices 280 include, but are not limited to, catalytic converters (two and three way), oxidation catalysts, lean NOx traps, hydrocarbon adsorbers, selective catalytic reduction (SCR) systems, and particulate filters. Other embodiments may include an exhaust gas recirculation (EGR) system 300 coupled between the exhaust manifold 225 and the intake manifold 200. The EGR system 300 may include an EGR cooler 310 to reduce the temperature of the exhaust gases in the EGR system 300. An EGR valve 320 regulates a flow of exhaust gases in the EGR system 300.

The automotive system 100 may further include an electronic control module (ECM) 450 in communication with one or more sensors and/or devices associated with the ICE 110. The ECM 450 may receive input signals from various sensors configured to generate the signals in proportion to various physical parameters associated with the ICE 110. The sensors include, but are not limited to, a mass airflow and temperature sensor 340, a manifold pressure and temperature sensor 350, a combustion pressure sensor 360, coolant and oil temperature and level sensors 380, a fuel rail pressure sensor 400, a cam position sensor 410, a crank position sensor 420, exhaust pressure and temperature sensors 430, an EGR temperature sensor 440, and a position sensor 445 of an accelerator pedal 446. Furthermore, the ECM 450 may generate output signals to various control devices that are arranged to control the operation of the ICE 110, including, but not limited to, the fuel injectors 160, the throttle body 330, the EGR Valve 320, the VGT actuator 290, and the cam phaser 155. In general dashed lines are used to indicate communication between the ECM 450 and the various sensors and devices, but some are omitted for clarity.

The automotive system 100 may further include an electric generator 500, for instance an alternator, which converts mechanical energy to electrical energy. The electric generator 500 is mechanically coupled to the crankshaft 145, in order to get the mechanical energy from the ICE 110. The electrical energy generated by the electric generator 500 is used to charge an electric battery 505 and to power electric devices of the automotive system 100, such as for example the fuel injectors 160, the ECM 450 and the sensors, when the ICE 110 is running. On the other hand, the electric battery 505 stores electrical energy that is used to power a starter motor (not shown) and other ancillaries, such as lights, electric motors and various electric devices of the automotive system 10X), when the ICE 110 is not running. The electric battery 505 may be also used to support the electric generator 500 in powering the electric devices of the automotive system 100 when the ICE 110 is running.

The operation of electric generator 500 may be controlled by the ECM 450. In particular, the ECM 450 may be configured to generate a Pulse Width Modulation (PWM) electric signal, conventionally referred as to L-terminal signal, whose duty cycle is proportional to an amount of electrical energy that the electric generator 500 has to supply to the electric battery 505 in order to charge it. This L-terminal signal is provided to an electronic control module 510 of the electric generator 500, which uses the L-terminal signal to operate the electric generator 500 and which generates in its turn another PWM electric signal, conventionally referred as to F-terminal signal, whose duty-cycle is proportional to an amount of mechanical energy that the ICE 110 is supplying to the electric generator 500 to charge the electric battery 505. In particular, the duty cycle of the F-terminal signal represents the percentage of the mechanical energy generated by the ICE 110, which is converted by the electric generator 500 into electrical energy to charge the electric battery 505. The duty cycle of the F-terminal signal is generally strictly related to the state of charge of the electric battery 505: the lower is the state of charge of the electric battery 505 the larger is the duty cycle of the F-terminal signal (and thus the percentage of mechanical energy converted into electrical energy to charge the electric battery 505) and vice versa. The F-terminal signal is fed back to the ECM 450 for control purposes as explained hereinafter.

Turning now to the ECM 450, this apparatus may include a digital central processing unit (CPU) in communication with a memory system and an interface bus. The CPU is configured to execute instructions stored as a program in the memory system 460, and send and receive signals to/from the interface bus. The memory system 460 may include various storage types including optical storage, magnetic storage, solid state storage, and other non-volatile memory. The interface bus may be configured to send, receive, and modulate analog and/or digital signals to/from the various sensors and control devices. The program may embody the methods disclosed herein, allowing the CPU to carryout out the steps of such methods and control the ICE 110.

The program stored in the memory system 460 is transmitted from outside via a cable or in a wireless fashion. Outside the automotive system 100 it is normally visible as a computer program product, which is also called computer readable medium or machine readable medium in the art, and which should be understood to be a computer program code residing on a carrier, said carrier being transitory or non-transitory in nature with the consequence that the computer program product can be regarded to be transitory or non-transitory in nature.

An example of a transitory computer program product is a signal, e.g. an electromagnetic signal such as an optical signal, which is a transitory carrier for the computer program code. Carrying such computer program code can be achieved by modulating the signal by a conventional modulation technique such as QPSK for digital data, such that binary data representing said computer program code is impressed on the transitory electromagnetic signal. Such signals are e.g. made use of when transmitting computer program code in a wireless fashion via a wireless connection to a laptop.

In case of a non-transitory computer program product the computer program code is embodied in a tangible storage medium. The storage medium is then the non-transitory carrier mentioned above, such that the computer program code is permanently or non-permanently stored in a retrievable way in or on this storage medium. The storage medium can be of conventional type known in computer technology such as a flash memory, an Asic, a CD or the like.

Instead of an ECM 450, the automotive system 100 may have a different type of processor to provide the electronic logic, e.g. an embedded controller, an onboard computer, or any processing module that might be deployed in the vehicle.

In order to operate the ICE 110, the ECM 450 is generally configured to command each one of the fuel injectors 160 to inject a predetermined fuel requested quantity (block S100 of FIG. 3) into the corresponding cylinder 140.

While the ICE 110 is operating, the ECM 450 may be also configured to execute a learning procedure (block S105) aimed to learn how much the fuel quantity actually injected by the fuel injector 160 deviates from the fuel requested quantity, particularly when the fuel requested quantity corresponds to a small quantity (e.g. the fuel quantity of a pilot injection). This learning procedure may be executed while the automotive system 100 is standing still with the ICE 110 uncoupled to the drivetrain, for example in a factory at the end of the production line or in a garage after that one of the fuel injectors 160 has been replaced.

As a first step, the learning procedure may provide for the ECM 450 to adjust the fuel requested quantity by controlling the engine speed (i.e. the rotational speed of the crankshaft 145) in a closed-loop control, so that the engine speed matches a predetermined target value thereof (block S110). In particular, this closed-loop control cycle may provide for the ECM 450 to measure a value of the engine speed (e.g. by means of the crankshaft position sensor 420), to calculate a difference between the measured value of the engine speed and the target value thereof, and to use such difference as input of a controller (e.g. a proportional controller, a proportional-integrative controller or a proportional-integrative-derivative controller) that yields as output an adjusted value of the fuel requested quantity that minimizes the calculated difference. The target value of the engine speed during the learning procedure may be the idle speed, namely the rotational speed that the crankshaft 145 runs on when the ICE 110 is uncoupled to the drivetrain and the accelerator pedal 446 is completely released. Contemporaneously, the learning procedure may provide for the ECM 450 to set a target value $FDC_{tar}$ of the duty-cycle of the F-terminal signal (block S115) and then to adjust the duty cycle of the L-terminal signal by means of a closed-loop control that uses a target value $FDC_{tar}$ of the duty-cycle of the F-terminal signal as one of its inputs (block S120).

In particular, this closed-loop control cycle may provide for the ECM 450 to measure a value of a feed-back signal from the control module 510 of the electric generator 500 (wherein the feed-back signal may be OBDII compliant), to calculate a difference between the measured value of said feed-back signal and a target value thereof (by way of example, the target vale of the feed-back signal may depend of the target value $FDC_{tar}$ of the duty-cycle of the F-terminal signal), and to use such difference as input of a controller (e.g. a proportional controller, a proportional-integrative controller or a proportional-integrative-derivative controller) that yields as output an adjusted value of the duty cycle of the L-signal that minimizes the calculated difference.

According to an aspect of the present disclosure, the target value $FDC_{tar}$ of the duty cycle of the F-terminal signal may be selected from a set of different values thereof, for example from a set of three different values, including a first value (e.g. 35%) which is representative of a low state of charge of the electric batten 505, a second value (e.g. 45%) which is representative of a middle state of charge of the electric battery 505 and a third value (e.g. 55%) which is representative of a high state of charge of the electric battery 505.

Figure 4:
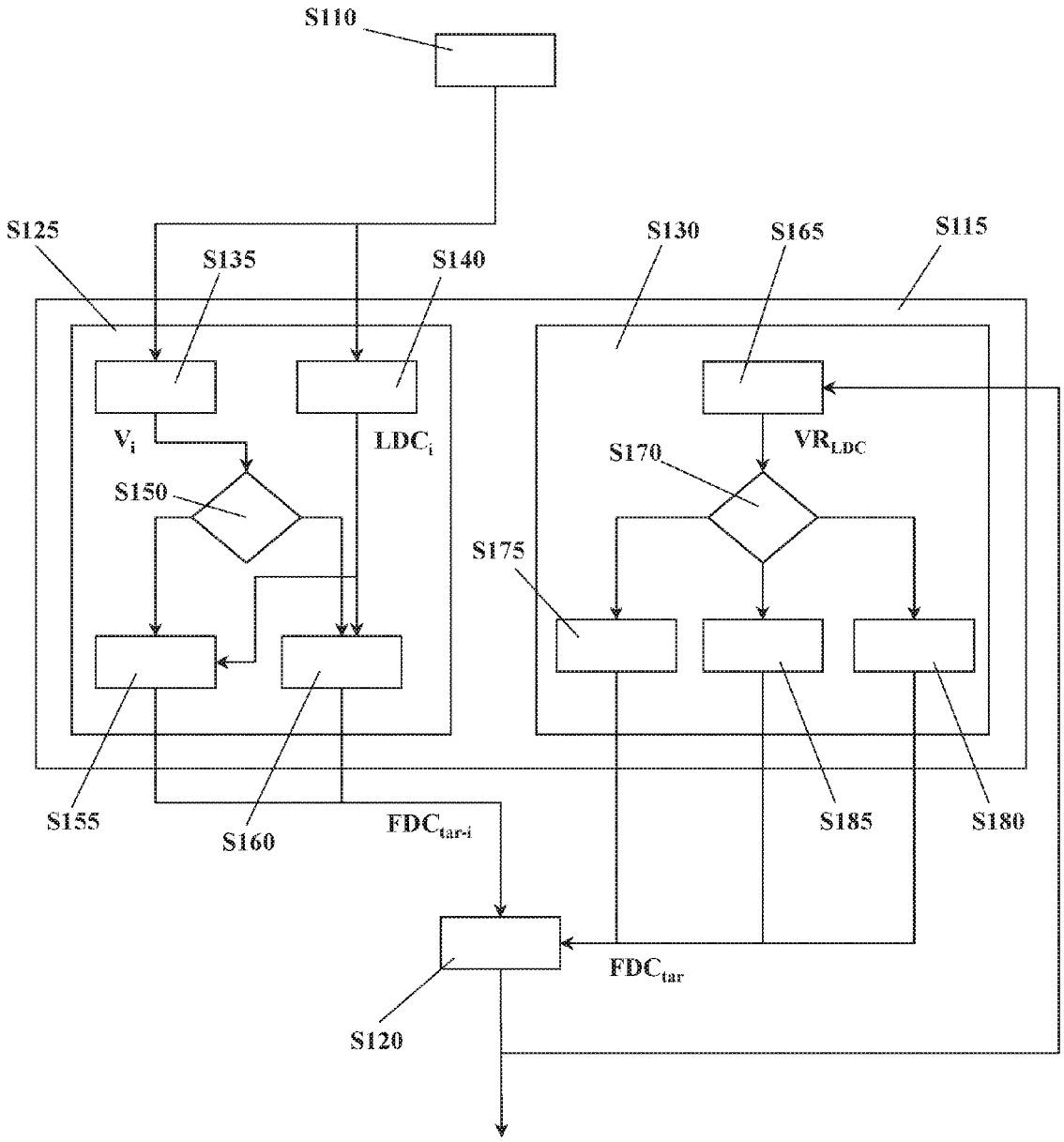
FIG. 4 is a flowchart of a subroutine involved in the method represented in FIG. 3.

As better shown in the flowchart of FIG. 4, the selection of the target value $FDC_{tar}$ of the duty cycle of the F-terminal signal may be performed by the ECM 450 in two phases, including a first phase (block S125) in which a preliminary target value $FDC_{tar-i}$ of the duty cycle of the F-terminal signal is selected, and a second phase (block S130) in which the preliminary target value $FDC_{tar-i}$ may be corrected in order to eventually provide a target value $FDC_{tar}$ that better represents the current state of charge of the electric battery 505.

In greater details, the first phase of the selection may provide for the ECM 450 to measure a value $V_i$ of a voltage generated by the electric battery 505 (block S135), to measure a value $LDC_i$ of the duty cycle of the L-terminal signal (block S140), and to select the preliminary target value $FDC_{tar-i}$ of the duty cycle of the F-terminal signal on the basis of the measured values of the voltage and of the duty cycle of the L-terminal signal. By way of example, the ECM 450 may compare the measured value $V_i$ of the voltage with a predetermined threshold value $V_{th}$ thereof (block S150). If the measured value $V_i$ of the voltage is smaller than or equal to the threshold value $V_{th}$, the ECM 450 will select the preliminary target value of the duty cycle of the F-terminal from a first subset (block S155) of the aforementioned values, for example from a subset including only the first value and the second value. If conversely the measured value $V_i$ of the voltage is larger than the threshold value $V_{th}$, the ECM 450 will select the preliminary target value of the duty cycle of the F-terminal from a second subset (block S160) of the aforementioned values, for example from a subset including only the second value and the third value.

The value $V_i$ of the voltage may be measured by means of a voltmeter (not shown) disposed in the electric circuit of the electric battery 505. The threshold value $V_{th}$ of the voltage may be determined by means of an experimental activity and stored in the memory system 460 as a calibration parameter. Once the appropriate subset has been identified, the ECM 450 may use the measured value $LDC_i$ of the duty cycle of the L-terminal signal to select which one of the values contained in the subset has to be appointed as preliminary target value $FDC_{tar-i}$ of the duty cycle of the F-terminal signal and used as input of the closed-loop control described above. The value $LDC_i$ of the duty cycle of the L-terminal signal may be measured by means of an oscilloscope (not shown) connected to the ECM 450 to receive the L-terminal signal.

At this point, the second phase may provide for the ECM 450 to calculate a variation rate $VR_{LDC}$ of the duty cycle of the L-terminal signal (block S165) as adjusted by the closed-loop-control on the basis of the preliminary target value $FDC_{tar-i}$ of the duty cycle of the F-terminal signal. In other words, the ECM 450 may measure a plurality of values of the duty cycle of the L-terminal signal and then calculate the variation rate $VR_{LDC}$ as a function of such measured values. The variation rate $VR_{LDC}$ of the duty cycle of the L-terminal signal is then compared with a negative threshold value $VR_{LDC_th1}$ and with a positive threshold value $VR_{LDC_th2}$ thereof (block S170).

If the variation rate $VR_{LDC}$ of the duty cycle of the L-terminal signal is larger than the positive threshold value $VR_{LDC_th2}$, it means that the preliminary target value $FDC_{tar-i}$ of the duty cycle of the F-terminal signal is too high. In this case, the preliminary target value is thus decreased (block S175). By way of example, if the preliminary target value $FDC_{tar-i}$ was the third value of the set (e.g. 55%), the ECM 450 would decrease it by setting the second value of the set (e.g. 45%) as the new target value. Then the check is repeated and the target value possibly corrected again until reaching the lower value of the set (e.g. 35%). The aforementioned positive threshold value $VR_{LDC_th2}$ of the variation rate of the duty cycle of the L-terminal signal may be determined with an experimental activity and stored in the memory system 460 as a calibration parameter.

If conversely the variation rate $VR_{LDC}$ of the duty cycle of the L-terminal signal is smaller than the negative threshold value $VR_{LDC_th1}$, it means that the preliminary target value $FDC_{tar-i}$ of the duty cycle of the F-terminal signal is too low. In this case, the preliminary target value $FDC_{tar-i}$ is thus increased (block S180). By way of example, if the preliminary target value $FDC_{tar-i}$ was the first value of the set (e.g. 35%), the ECM 450 would increase it by setting the second value of the set (e.g. 45%) as the new target value. Then the check is repeated and the target value possibly corrected again until reaching the higher value of the set (e.g. 55%). The aforementioned negative threshold value $VR_{LDC_th1}$ of the variation rate of the duty cycle of the L-terminal signal may be determined with an experimental activity and stored in the memory system 460 as a calibration parameter.

On the other hand, if (or when) the variation rate $VR_{LDC}$ of the duty cycle of the L-terminal signal is included between the negative threshold value $VR_{LDC_th1}$ and the positive threshold value $VR_{LDC_th2}$ thereof, the preliminary target value (or the last corrected target value) of the duty cycle of the F-terminal signal is eventually set (block S185) as the final target value $FDC_{tar}$ to be used in the closed-loop control for the learning.

Figure 3:
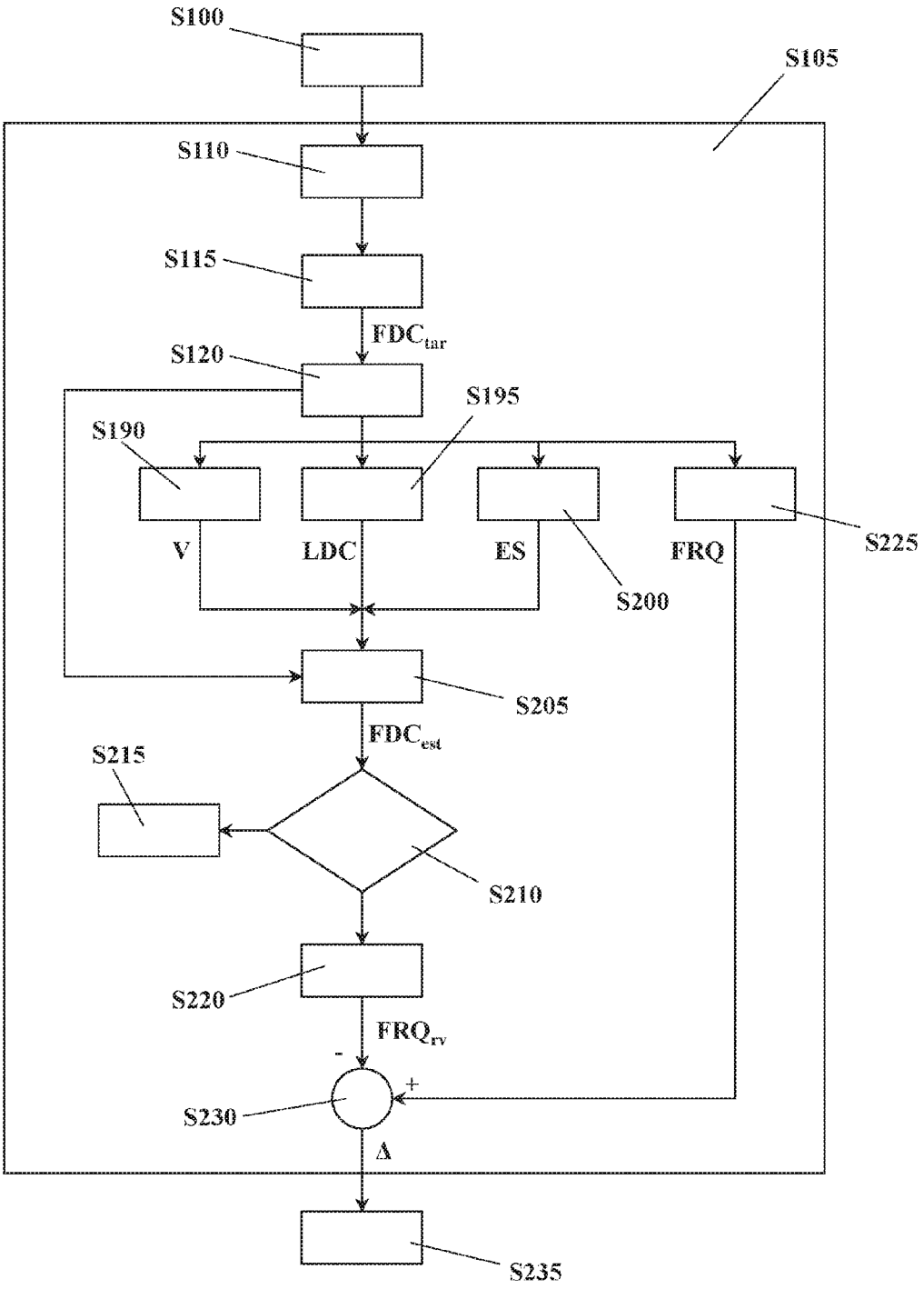
FIG. 3 is a flowchart of a method for operating the internal combustion engine according to an embodiment of the disclosure.

At this point, while the requested fuel quantity is adjusted by closed-loop controlling the engine speed to match the target value thereof, and while the duty cycle of the L-terminal signal is adjusted by the aforementioned closed-loop control, on the basis of the finally selected target value $FDC_{tar}$ od the duty cycle of the F terminal signal, the learning procedure may provide for the ECM 450 to carry out the steps detailed hereinafter and indicated in FIG. 3.

In a first phase, the ECM 450 may be configured to measure a value V of the voltage generated by the electric battery 505 (block S190), to measure a value LDC of the duty cycle of the L-terminal signal (block S195) and to measure a value ES of the engine speed (block S200). As explained above, the value V of the voltage may be measured by means of a voltmeter (not shown) disposed in the electric circuit of the electric battery 505, the value LDC of the duty cycle of the L-terminal signal may be measured by means of an oscilloscope (not shown) connected to the ECM 450 to receive the L-terminal signal, and the value ES of the engine speed may be measured by means of the crankshaft position sensor 420. All these measurements comply with the requirements of the OBD-II standards, which make them robust and reliable.

In a second phase, the ECM 450 may be configured to estimate (block S205) a value $FDC_{est}$ of the duty cycle of the F-terminal signal as a function of the measured value V of the voltage, the measured value ES of the engine speed and the measured value LDC of the duty cycle of the L-terminal signal, taking also into account the finally selected target value $FDC_{tar}$ of the duty cycle of the F-terminal signal. By way of example the estimated value $FDC_{est}$ of the duty cycle of the F-terminal signal may be calculated with the following equation:

$$FDC_{est}=(LDC\cdot k_1+V\cdot k_2)\cdot k_3$$

wherein:

LDC is the value of the first parameter;

V is the voltage value;

$k_1$ and $k_2$ are numeric coefficients determined on the basis of the target value of the second parameter; and $k_3$ is a numeric coefficient determined on the basis of the target value of the second parameter and the engine speed value.

It should be observed that, since all the values involved in this estimation are OBD-II compliant, also the estimated value $FDC_{est}$ of the duty cycle of the F-terminal signal results OBD-II compliant and is thus robust and reliable enough to guarantee an high accuracy of the learning procedure.

The numeric coefficients $k_1$, $k_2$ and $k_3$ may be determined, for each one of the target values of the duty cycle of the F-terminal signal that are selectable (e.g. 35%, 45% and 55%), by means of an experimental activity that provides for operating a test ICE under the same conditions of the learning procedure, in particular by adjusting the fuel requested quantity by closed-loop controlling the engine speed and by adjusting the duty cycle of the L-terminal signal with the closed loop control of the generator that has been explained above. While the test ICE is operating this way, the experimental activity may provide for measuring corresponding values of the battery voltage, of the engine speed, of the duty cycle of the L-terminal signal and of the duty cycle of the F-terminal signal. This measurement may be repeated at least three times, in order to be able to solve a system of three equations of the kind described above, which yields the tree numeric coefficients $k_1$, $k_2$ and $k_3$. These coefficients may then be stored in the memory system 460 as calibration parameters. In particular, they may be stored in a map and correlated to the target value of the duty cycle of the F-terminal signal used during the experimental activity.

In this way, in the execution of the learning procedure, the ECM 450 may retrieve from the map the numeric coefficients $k_1$ and $k_2$ that correspond to the selected target value $FDC_{tar}$ of the duty cycle of the F-terminal signal, as well as the numeric coefficient and $k_3$ that correspond to the selected target value $FDC_{tar}$ of the duty cycle of the F-terminal signal and to the current engine speed value EN.

Once the value of the duty cycle of the F-terminal signal has been estimated, the learning procedure may provide for the ECM 450 to calculate a difference between such estimated value $FDC_{est}$ and the target value $FDC_t$, of the duty cycle of the F-terminal signal and to compare the modulus (i.e. the absolute value) of such difference with a predetermined offset ΔFDC (block S210). The offset ΔFDC may be determined with an experimental activity and stored in the memory system as a calibration parameter.

If the modulus of the difference between the estimated value $FDC_{est}$ of the duty cycle of the F-terminal signal and the target value $FDC_{tar}$ thereof is larger than the predetermined offset ΔFDC, it means that something went wrong during the estimation. In this case, the learning procedure may be aborted and the ECM 450 may be configured to generate an alert signal indicative of the failure of the learning procedure (block S215).

The learning procedure may also be aborted if the measured value LDC of the duty cycle of the L-terminal signal becomes smaller than a first threshold value $LDC_{th1}$ or larger than a second bigger threshold value $LDC_{th2}$ thereof. The first and second threshold values $LDC_{th1}$ and $LDC_{th2}$ may be determined with an experimental activity and stored in the memory system as calibration parameters.

If conversely the modulus of the difference between the estimated value $FDC_{est}$ of the duty cycle of the F-terminal signal and the target value $FDC_{tar}$ thereof is smaller than or equal to the predetermined offset, and the measured value LDC of the duty cycle of the L-terminal signal remains included between the first threshold value $LDC_{th1}$ and the second threshold value $LDC_{th2}$, the learning procedure may provide for the ECM 450 to use the estimated value $FDC_{est}$ to determine a reference value $FRQ_{rv}$ of the fuel requested quantity (block S220). The reference value $FRQ_{rv}$ of the fuel requested quantity corresponds to the fuel quantity that would be requested from a nominal fuel injector in order to bring and keep the engine speed at the target value prescribed by the learning procedure (i.e. the idle speed).

There is indeed a strict relation between the fuel requested quantity and the duty cycle of the F-terminal signal. As a matter of fact, considering that the ICE 110 is uncoupled from the drivetrain, the duty cycle of the F-terminal signal represents the percentage of the mechanical energy generated by the fuel combustion which is used to charge the electric battery 505, whereas the engine speed is sustained only by the remaining percentage. As a consequence, if the duty cycle of the F-terminal signal is low, the percentage of mechanical energy used to keep the engine speed at the target value thereof would be correspondently low, so that a relatively small fuel requested quantity would be enough to achieve the task (e.g. 3 $mm^3$). On the other hand, if the duty cycle of the F-terminal signal is high, the percentage of mechanical energy used to keep the engine speed at the target value thereof would be correspondently high and the fuel requested quantity would be larger (e.g. 5 $mm^3$).

To determine the reference value $FRQ_{rv}$, of the fuel requested quantity, the ECM 450 may use the estimated value $FDC_{est}$ of the duty cycle of the F-terminal signal as input of a calibration map that yields as output a corresponding value of the fuel requested quantity.

This map may be obtained by means of an experimental activity that includes the steps of operating a test ICE having nominal fuel injectors under the condition of the learning procedure and of recording, for different values of the duty cycle of the F-terminal signal, the value of the fuel requested quantity necessary to bring and keep the engine speed at the target value thereof (i.e. idle speed). The map may then be stored in the memory system 460.

If the estimated value $FDC_{est}$ of the duty cycle of the F-terminal signal is not among those that were tested during the experimental activity, the ECM 450 may calculate the correspondent reference values $FRQ_{rv}$ of the fuel requested quantity as an interpolation of the reference values that correspond to the nearest tested values of the duty cycle of the F-terminal signal.

In the meantime, the learning procedure may provide for the ECM 450 to get an actual value FRQ of the fuel requested quantity (block S225). Since the fuel requested quantity is a parameter which is generated by the ECM 450 in accordance with the closed-loop control of the engine speed, the actual value FRQ of the fuel requested quantity is generally available for the ECM 450.

At this point, the learning procedure may provide for the ECM 450 to calculate a difference Δ (block S230) between the actual value of the fuel requested quantity and the reference value thereof:

$$\Delta = FRQ - FRQ_{rv}.$$

This difference Δ, which represents how much the fuel quantity injected by the real fuel injector 160 deviates from the fuel quantity injected by the nominal fuel injector, may be stored in the memory system to be used to control the operation of the ICE 110 outside of the learning procedure (block S235).

In particular, outside of the learning procedure (namely when the learning procedure is not executed), the ECM 450 may be configured to determine the fuel requested quantity according to an open-loop control strategy based on control parameters such as the engine torque requested by the driver through the accelerator pedal 446, or based on other logics. In other words, the values of the fuel requested quantity are determined in a pre-defined way (e.g. by means of mathematical models, map or the like) as a function of, or on the basis of, the aforementioned parameters or logic, without any feedback on how the fuel injector 160 actually reacts. Since the open-loop control strategy is generally calibrated on the nominal fuel injector, the values of the requested fuel quantity provided by this strategy may lead the fuel injector 160 to inject a quantity of fuel which is different from the requested one. To reduce this gap, especially when small fuel injections are involved (e.g. pilot injection), the values of the requested fuel quantity yielded by the open-loop control strategy may be corrected with (e.g. added to) the difference Δ calculated during the learning procedure disclosed above.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. A method of operating an internal combustion engine comprising:

commanding a fuel injector of the internal combustion engine to inject a fuel requested quantity;

adjusting the fuel requested quantity by closed-loop controlling an engine speed to match a target value thereof;

measuring a value of a first parameter indicative of an amount of electrical energy supplied to an electric battery by an electric generator operably coupled to the internal combustion engine;

measuring a voltage value of a voltage generated by the electric battery;

measuring a speed value of the engine speed;

setting a target value of a second parameter indicative of an amount of mechanical energy supplied by the internal combustion engine to the electric generator;

adjusting the first parameter by closed-loop controlling the second parameter to match the target value thereof;

calculating a reference value of the fuel requested quantity on the basis of the voltage value, the engine speed value and the value of the first parameter, wherein the target value of the second parameter is used for the calculation of the reference value of the fuel requested quantity;

calculating a difference between the value of the adjusted fuel requested quantity and the reference value; and using the calculated difference to control the operation of the internal combustion engine, wherein setting the target value of the second parameter comprises:

calculating a variation rate of the first parameter over time;

decreasing the target value of the second parameter when the variation rate of the first parameter is greater than a predetermined positive threshold value thereof; and increasing the target value of the second parameter when the variation rate of the first parameter is smaller than a predetermined negative threshold value thereof.

2. The method according to claim 1, wherein the calculation of the reference value of the fuel requested quantity comprises:

estimating a value of the second parameter on the basis of the voltage value, the engine speed value, the value of the first parameter and the target value of the second parameter; and determining the reference value of the fuel requested quantity on the basis of the estimated value of the second parameter.

3. The method according to claim 2, further comprising generating a failure signal when a difference between the estimated value of the second parameter and the target value thereof is larger than a predetermined threshold.

4. The method according to claim 1, wherein setting the target value of the second parameter comprises:

measuring a value of the voltage generated by the electric battery;

measuring a value of the first parameter;

determining the target value of the second parameter on the basis of the voltage value and of the value of the first parameter.

5. A non-transitory computer readable medium comprising a computer program having programmed instructions for performing the method according to claim 1 when executed on a computer.

6. A control apparatus for an internal combustion engine, comprising an electronic control module, a memory store associated to the electronic control module and the computer program of claim 5 stored in the memory store.

7. A method of operating an internal combustion engine comprising:

commanding a fuel injector of the internal combustion engine to inject a fuel requested quantity;

adjusting the fuel requested quantity by closed-loop controlling an engine speed to match a target value thereof;

measuring a value of a first parameter indicative of an amount of electrical energy supplied to an electric battery by an electric generator operably coupled to the internal combustion engine;

measuring a voltage value of a voltage generated by the electric battery;

measuring a speed value of the engine speed;

calculating a reference value of the fuel requested quantity on the basis of the voltage value, the engine speed value and the value of the first parameter, wherein the calculating comprises:

setting a target value of a second parameter indicative of an amount of mechanical energy supplied by the internal combustion engine to the electric generator;

adjusting the first parameter by closed-loop controlling the second parameter to match the target value thereof; and using the target value of the second parameter for the calculation of the reference value of the fuel requested quantity;

calculating a difference between the value of the adjusted fuel requested quantity and the reference value; and using the calculated difference to control the operation of the internal combustion engine, wherein the calculation of the reference value of the fuel requested quantity comprises:

estimating a value of the second parameter on the basis of the voltage value, the engine speed value, the value of the first parameter and the target value of the second parameter; and determining the reference value of the fuel requested quantity on the basis of the estimated value of the second parameter;

wherein estimation of the value of the second parameter comprises calculating the value $FDC_{est}$ of the second parameter with the following equation:

$$FDC_t=(LDC\cdot k_1+V\cdot k_2)\cdot k_3$$

wherein:

LDC is the value of the first parameter;

V is the voltage value;

$k_1$ and $k_2$ are numeric coefficients determined on the basis of the target value of the second parameter; and $k_3$ is a numeric coefficient determined on the basis of the target value of the second parameter and the engine speed value.

* * * * *